US005546841A

United States Patent [19]

Chen

[11] Patent Number: 5,546,841

[45] Date of Patent: Aug. 20, 1996

[54] DRUM ASSEMBLY

[76] Inventor: Ming-Hawi Chen, No. 581, Wen Chu Road, Da Jia Town, Taichung, Taiwan

[21] Appl. No.: 410,512

[22] Filed: Mar. 24, 1995

[51] Int. Cl.[6] ..... G10D 13/02

[52] U.S. Cl. ..... 84/411 R; 84/421

[58] Field of Search ..... 84/421, 411 R, 84/419, 411 A, 413; 248/220.2, 316.8

[56] References Cited

U.S. PATENT DOCUMENTS 4,448,105 5/1984 Cordes ..... 84/411 R

*Primary Examiner*—Cassandra C. Spyrou
*Attorney, Agent, or Firm*—Charles E. Baxley, Esquire

[57] ABSTRACT

A drum includes a cylindrical body having two rims engaged on the upper and lower portion. A pair of frames are engaged on the rims and each has a number of ears extended radially outward. A number of posts are secured between two rings and are engaged between the ears of the frames. The ears of the frames are fixed to the posts so as to secure the frames together and so as to secure the cylindrical body and the rims between the frames. The drum may be assembled without forming fastening holes in the cylindrical body.

1 Claim, 3 Drawing Sheets

DRUM ASSEMBLY

BACKGROUND OF THE INVENTION

1. Field of the Invention

The present invention relates to a drum, and more particularly to a drum assembly that may be easily assembled without providing holes in the drum body.

2. Description of the Prior Art

Typical drums comprise a cylindrical body having two frames secured to the upper and lower portions for securing two membranes to the drum However, the cylindrical body should be formed with a number of fastening holes so as to secure a number of couplers to the cylindrical body and so as to secure the frames to the cylindrical body. The couplers are then fixed to a support stand and the like. However, the holes spoil the quality of the sound.

The present invention has arisen to mitigate and/or obviate the afore-described disadvantages of the conventional drums.

SUMMARY OF THE INVENTION

The primary objective of the present invention is to provide a drum assembly which may be assembled without forming holes in the cylindrical body of the drum.

In accordance with one aspect of the invention, there is provided a drum assembly comprising a cylindrical body including an upper portion and a lower portion, a pair of rims engaged on the upper portion and the lower portion of the cylindrical body respectively and each including a membrane provided therein, a pair of frames engaged on the rims respectively and each including a plurality of ears extended radially outward therefrom, a pair of rings, a plurality of posts secured between the rings and engaged between the ears of the frames, means for securing the ears to the posts so as to secure the frames together and so as to secure the cylindrical body and the rims between the frames, and a panel including a pair of tubes secured thereto, the tubes being engaged with two of the posts so as to secure the panel to the posts. A fastener means is secured to the panel for securing to a support stand. The drum may be assembled without forming fastening holes in the cylindrical body.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
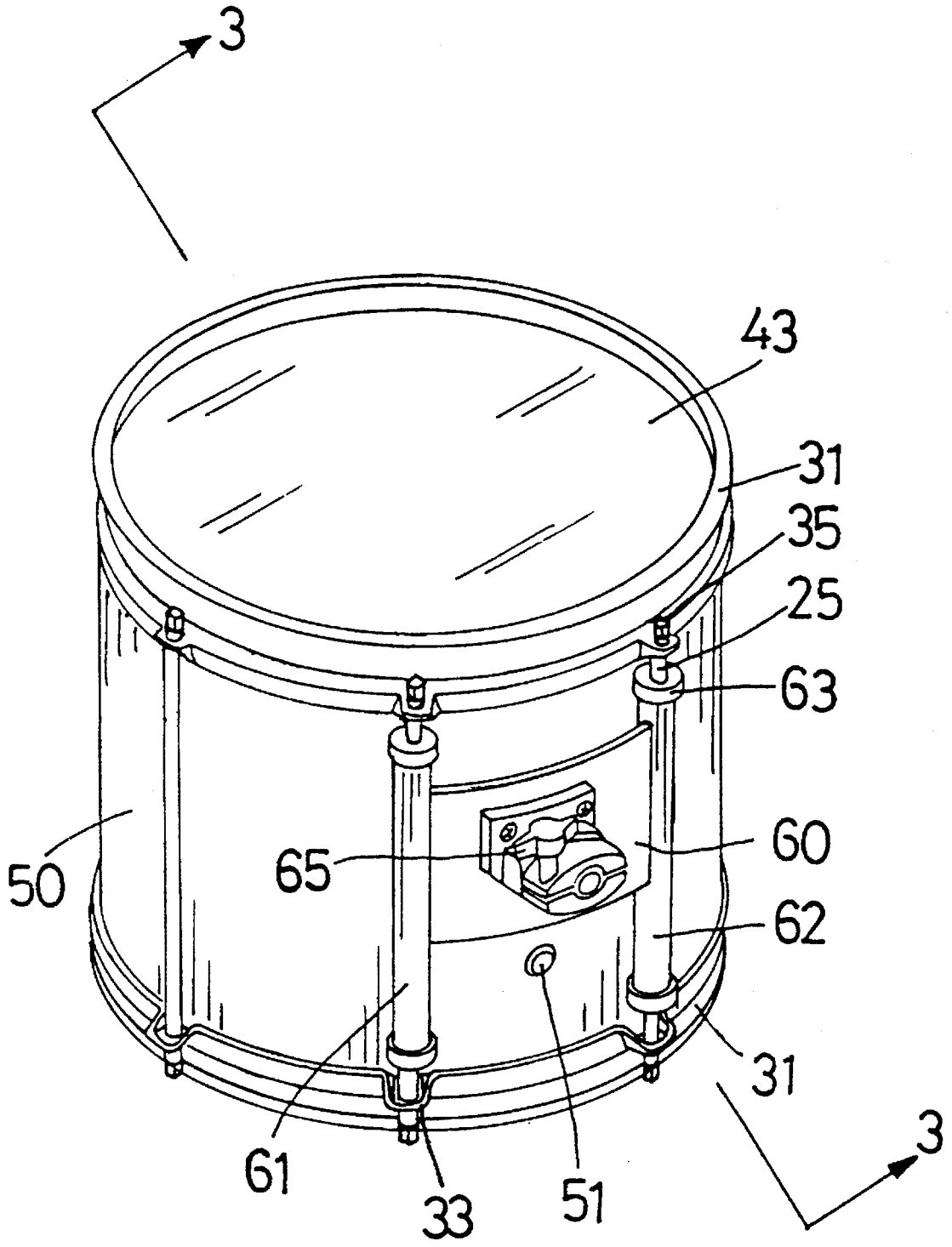
FIG. 1 is a perspective view of a drum assembly in accordance with the present invention.
Figure 2:
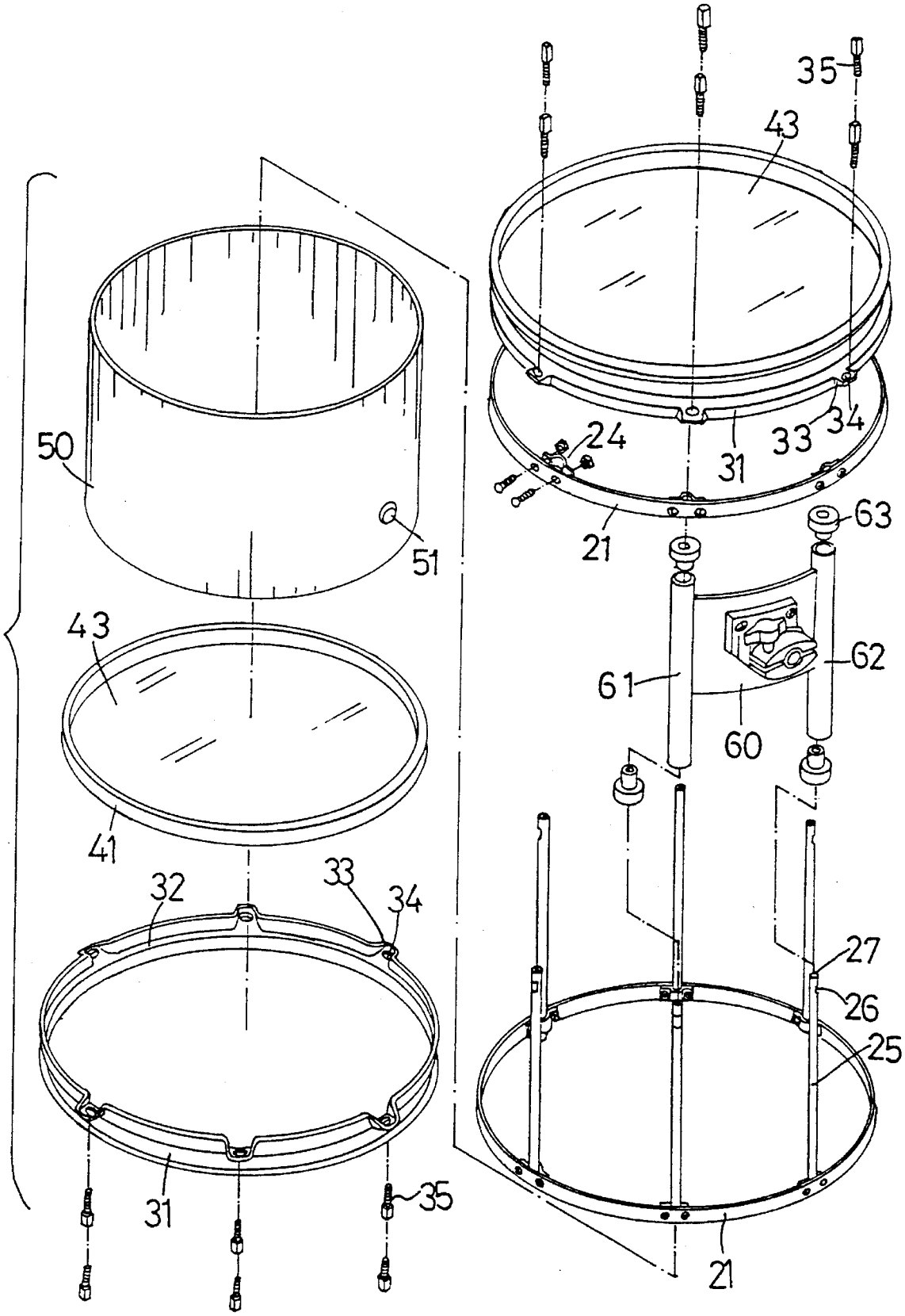
FIG. 2 is an exploded view of the drum assembly.
Figure 3:
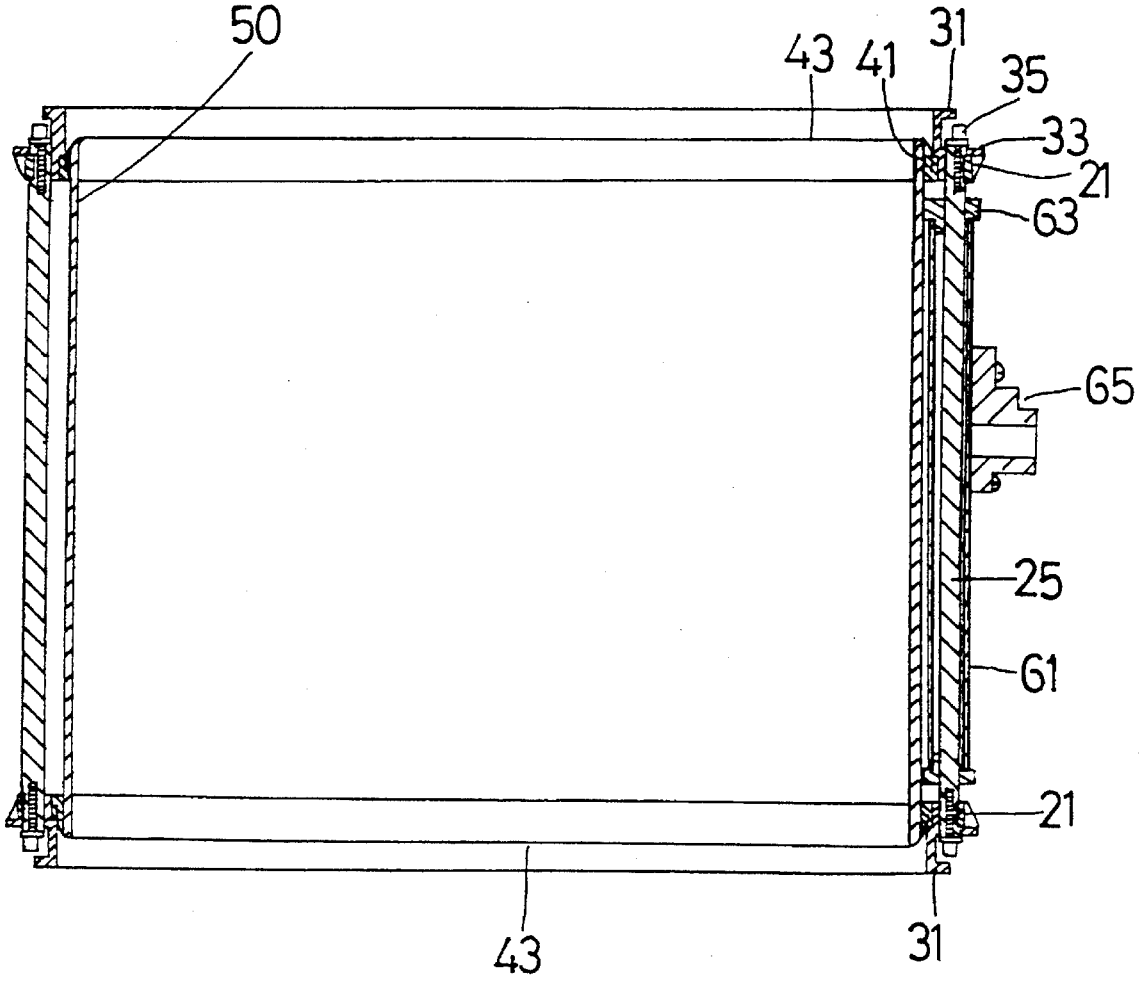
FIG. 3 is a cross sectional view taken along lines 3—3 of FIG. 1.

Referring to the drawings, a drum assembly in accordance with the present invention comprises a cylindrical body 50 including an opening 51 formed therein for resonance purposes. Two rims 41 are engaged on the upper and lower portion of the cylindrical body 50 and each includes a membrane 43 provided therein. Two frames 31 are engaged on the upper and lower portion of the cylindrical body 50. The frames 31 each includes an annular shoulder 32 formed therein for engaging with the rings 41 and each includes a number of ears 33 extended radially outward therefrom and having a hole 34 provided therein for engaging with bolts 35.

A number of posts 25 are fixed between two rings 21 by a number of fastening members 24 which are secured to the rings 21 by bolts. The posts 25 each includes two recesses 26 formed in the upper and lower portion for engaging with the fastening members 24 which solidly secure the posts 25 in place and which prevent the posts 25 from rotational movement. The posts 25 are engaged between the ears 33 of the frames 31 and each includes two ends each having a screw hole 27 formed therein for engaging with the bolts 35 such that the ears 33 of the frames 31 may be solidly secured to the posts 25. The cylindrical body 50 and the rims 41 may thus be solidly secured in place by the frames 31 and the rings 21. A panel 60 includes two tubes 61, 62 secured thereto for engaging with two of the posts 25. The panel 60 includes a fastener means 65 provided thereon for securing to support stand means. The upper and the lower ends of the tubes 61, 62 have washers or packings 63 provided therein for absorbing shocks and vibrations that may be transmitted to the tubes 61, 62.

Accordingly, the drum assembly in accordance with the present invention may be assembled together without forming fastening holes in the cylindrical body.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A drum assembly comprising:

a cylindrical body including an upper portion and a lower portion, a pair of rims engaged on said upper portion and said lower portion of said cylindrical body respectively and each including a membrane provided therein, a pair of frames engaged on said rims respectively and each including a plurality of ears extended radially outward therefrom, a pair of rings, a plurality of posts secured between said rings and engaged between said ears of said frames, means for securing said ears to said posts so as to secure said frames together and so as to secure the cylindrical body and said rims between said frames, and a panel including a pair of tubes secured thereto, said tubes being engaged with two of said posts so as to secure said panel to said posts.

* * * * *